US005651844A

United States Patent [19]

Longenberger

[11] Patent Number: 5,651,844

[45] Date of Patent: Jul. 29, 1997

[54] METAMORPHIC PROCESSING OF ALLOYS AND PRODUCTS THEREOF

[75] Inventor: Edward B. Longenberger, Perrysburg, Ohio

[73] Assignee: Brush Wellman Inc., Cleveland, Ohio

[21] Appl. No.: 692,981

[22] Filed: Aug. 7, 1996

Related U.S. Application Data

[63] Continuation of Ser. No. 382,131, Feb. 1, 1995, abandoned.

[51] Int. Cl.[6] ..... C22F 1/08

[52] U.S. Cl. ..... 148/683; 148/685

[58] Field of Search ..... 148/683, 685

[56] References Cited

U.S. PATENT DOCUMENTS

| | | | |
|---|---|---|---|
| 3,201,234 | 8/1965 | Scherbner | 420/476 |
| 4,067,750 | 1/1978 | Mravic | 148/554 |
| 4,077,811 | 3/1978 | Burman | 148/514 |
| 4,394,185 | 7/1983 | McClelland | 148/554 |
| 4,425,168 | 1/1984 | Goldstein | 148/554 |
| 4,565,586 | 1/1986 | Church et al. | 148/685 |
| 4,599,120 | 7/1986 | Church | 148/414 |
| 4,792,365 | 12/1988 | Matsui | 148/554 |
| 4,931,105 | 6/1990 | Woodward | 148/680 |
| 5,131,958 | 7/1992 | Sakai | 148/554 |
| 5,354,388 | 10/1994 | Nojiri | 148/554 |
| 5,388,319 | 2/1995 | Inoue | 148/519 |

FOREIGN PATENT DOCUMENTS

| | | |
|---|---|---|
| 390374A | 10/1990 | European Pat. Off. . |
| 0390374 | 10/1990 | European Pat. Off. . |
| 548636A | 6/1993 | European Pat. Off. . |
| 59-038367 | 3/1984 | Japan . |
| 04-218630 | 8/1992 | Japan . |

*Primary Examiner*—Sikyin Ip
*Attorney, Agent, or Firm*—Hopgood, Calimafde

[57] ABSTRACT

In accordance with one aspect of the present invention is the metamorphic processing of a beryllium-copper alloy. The alloy is (i) thermodynamically treated for greater than about 10 hours at a temperature generally within a range of 900° to 1500° F., (ii) warm worked at greater than about 30% strain at a strain rate $\dot{\varepsilon}$ greater than or equal to about $(2.210\times10^7)/\exp[(2.873\times10^4)/(T+459.4°)]$, where T is in ° F., at the temperature, (iii) annealed at a temperature between 1375° and 1500° F. for about 15 minutes to about 3 hours, (iv) water quenched, and (v) thermal hardened at a temperature generally within a range of about 480° and 660° F. Grain size is reduced with concomitant improvements in ultimate strength, toughness, total elongation, % reduction in area and ultrasonic inspectability.

33 Claims, 9 Drawing Sheets

Metamorphic Map For Alloy 25

Metamorphic Map For Alloy 165

Metamorphic Map For Alloy 3, Hycon 3HP™ & Phase 3HP

METAMORPHIC PROCESSING OF ALLOYS AND PRODUCTS THEREOF

This application is a continuation of application Ser. No. 08/382,131, filed Feb. 1, 1995, now abandoned.

FIELD OF THE INVENTION

The present invention relates to processing of precipitation hardenable materials and more particularly to a novel method for enhancing properties of beryllium containing alloys.

BACKGROUND OF THE INVENTION

Beryllium-copper alloys are notable for their superior combination of thermal conductivity, strength, toughness, impact energy and resistance to corrosion. This has made them desirable for use in control bearings of aircraft landing gear and a variety of underground and undersea applications. Additional benefits of beryllium-copper alloys such as their relatively high electrical conductivity, ultrasonic inspectability and thermal management has made them suitable for face plates of continuous steel casting molds. Aerospace and compact disc technologies have also benefitted, in particular, from the relatively high polishability of these alloys as well as their magnetic transparency, thermal cycling and anti-galling characteristics. The cost of beryllium-copper being an issue, however, more economical processing is sought. Improvements in alloy properties and enhanced product performance are also desired.

In this connection, conventional processing of beryllium-copper alloys have utilized a series of thermal and mechanical treatment steps. For example, a beryllium-copper alloy is cold rolled to heavy reduction, intermediate annealed at temperatures between about 1000° and 1750° F., solution annealed at temperatures of about 1600° to 1850° F., cold rolled to substantially finished gage, then aged at a temperature within a range of about 600° and 1000° F. for less than 1 hour to about 8 hours. An objective is to enhance strength, ductility, formability, conductivity and stress relaxation. A process of this general description may be found, for example, in U.S. Pat. No. 4,565,586 which issued on Jan. 21, 1986 and in U.S. Pat. No. 4,599,120 which issued on Jul. 8, 1986. The disclosures of both patents are hereby incorporated by reference herein.

Although prior methods of processing have been found useful, further improvements in strength and refinements in grain size are desired. For example, finer grain size with uniform equiaxed structure is sought for increased polishability of guidance system mirrors, i.e., to prevent arcing of lasers, and to improve surface quality of molds for manufacturing compact discs. Superior ductility, formability, ultrasonic inspectability and conductivity would ease product manufacture and reduce costs. Further resistance to heat and corrosion is desired to enhance product life and performance, e.g., of control bearings for aircraft landing gear. Moreover, by increasing the fatigue and creep strength of beryllium-copper face plates, performance of steel casting molds would be enhanced.

SUMMARY OF THE INVENTION

In accordance with one aspect of the present invention is the metamorphic processing of beryllium-copper alloys known as "gold" alloys. A specific, illustrative process comprises the steps of (i) thermodynamically treating the alloy at a first selected temperature generally within a range of 900° and 1500° F., (ii) warm working the alloy of step i at greater than about 30% strain at a strain rate $\dot{\epsilon}$ greater than or equal to about $(2.210\times10^7)/\exp[(2.873\times10^4)/(T+459.4°)]$, where T is in °F., at the first temperature, (iii) annealing the alloy of step ii at a second selected temperature generally within a range of 1375° and 1500° F., (iv) water quenching the alloy of step iii, and (v) thermal hardening the alloy of step iv at a third selected temperature generally within a range of 480° and 660° F. This produces a generally equiaxed uniform fine grain structure with concomitant improvements in mechanical properties and ultrasonic inspectability.

In accordance with another aspect of the present invention, a "gold" beryllium-copper alloy is (i) thermodynamically treated at a first selected temperature generally within a range of 900° and 1500° F., then (ii) warm worked at greater than about 30% strain at a strain rate $\dot{\epsilon}$ greater than or equal to about $(1.009\times10^8)/\exp[(2.873\times10^4)/(T+459.4°)]$, where T is in °F., at the first temperature, (iii) annealed at a second selected temperature generally within a range of 1375° and 1500° F., (iv) water quenched, and finally (v) thermal hardened at a third selected temperature generally within a range of about 480° and 660° F.

According to a further aspect of the invention is a metamorphically processed "gold" beryllium-copper alloy where 3.0 times the impact energy of the alloy in foot pounds plus 2.0 times the alloy yield strength in ksi is greater than about 275.

Metamorphic processing of a "red" beryllium-copper alloy, according to yet another aspect of the present invention, produces a generally equiaxed uniform grain structure with concomitant improvements in mechanical properties, electrical conductivity and ultrasonic inspectability. A specific, illustrative process comprises the steps of: (i) thermodynamically treating the alloy at a first selected temperature generally within a range of 900° and 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, (iii) annealing the alloy of step ii at a second selected temperature generally within a range of 1400° and 1750° F. for about 15 minutes to about 3 hours, (iv) water quenching the alloy of step iii, and (v) thermal hardening the alloy of step iv at a third selected temperature generally within a range of 800° and 1000° F.

According to still another aspect of the invention, a "red" beryllium-copper alloy is metamorphically processed by the steps of: (i) thermodynamically treating the alloy at a first selected temperature generally within a range of 900° and 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, (iii) annealing the alloy of step ii at a second selected temperature generally within a range of 1400° and 1750° F., (iv) water quenching the alloy of step iii, and (v) primary thermal hardening of the alloy of step iv at a third selected temperature generally within a range of 900° and 1000° F. followed by secondary thermal hardening at a fourth selected temperature generally within a range of 700° and 900° F.

In accordance with yet a further aspect of the invention is a metamorphically processed "red" beryllium-copper alloy where 4.5 times the electrical conductivity of the alloy in % IACS plus the alloy yield strength in ksi is greater than about 400.

Although the present invention is shown and described for use with beryllium-copper alloys, it is understood that analogous processes may be practiced on other precipitation hardenable materials such as alloys of aluminum, titanium and iron, giving consideration to the purpose for which the present invention is intended. Also, any alloy containing beryllium, including beryllium-nickel and beryllium-silver alloys, are considered within the spirit and scope of the invention.

It is therefore an object of the present invention to improve strength and toughness of beryllium containing alloys while improving their resistance to heat and corrosion, ductility, formability and conductivity.

Another object of the present invention is to produce beryllium containing alloys with enhanced mechanical properties, simply and efficiently.

Still another object of the present invention is to provide an economical beryllium containing alloy product with enhanced mechanical properties.

A further object of the present invention is to improve fatigue strength, creep strength, and ultrasonic inspectability.

Still a further object of the present invention is to achieve finer polishing of guidance system mirrors and molds for manufacturing compact discs.

The present invention will now be described by reference to the following drawings which are not intended to limit the accompanying claims.

BRIEF DESCRIPTION OF THE DRAWINGS

The same numerals are used throughout the various figures to designate similar elements.

Still other objects and advantages of the present invention will become apparent from the following description of the preferred embodiments.

DETAILED DESCRIPTION OF THE PREFERRED EMBODIMENTS

Metamorphic alloy processing is a revolution in metallurgy. During processing, a metamorphosis takes place in the alloy somewhat analogous to that of a caterpillar's transformation into a butterfly. During an intermediate or "cocoon" stage of processing, the grain structure of the alloy becomes ugly, i.e., random, nonuniform, and chaotic. Further processing brings order out of the chaos and a super alloy emerges having a combination of properties and characteristics which are not only unique, but surpass those of any known material.

Generally speaking, the terms "gold" and "red" alloys as used herein are intended to describe alloy appearance. Typically, a "gold" beryllium-copper alloy contains concentrations of beryllium sufficient to give the alloy a golden color. A "red" alloy typically contains relatively lesser amounts of beryllium, creating a reddish hue like that of copper.

In accordance with one aspect of the present invention is the metamorphic processing of a "gold" beryllium-copper alloy, e.g., Alloy 25 (C17200), which comprises the steps of (i) thermodynamically treating the alloy at a first selected temperature generally within a range of 900° and 1500° F., (ii) warm working the alloy of step i at greater than about 30% strain at a strain rate $\dot{\epsilon}$ greater than or equal to about $(2.210\times10^7)/\exp[(2.873\times10^4)/(T+459.4°)]$, where T is in °F., at the first temperature, (iii) annealing the alloy of step ii at a second selected temperature generally within a range of 1375° and 1500° F., (iv) water quenching the alloy of step iii, and (v) thermal hardening the alloy of step iv at a third selected temperature generally within a range of 480° and 660° F.

Alloy 25 has been found desirable for use in underground positional sensing equipment for oil and gas drilling, as well as control bearings for aircraft landing gear. More notable characteristics in this context include strength, toughness, impact energy, corrosion resistance, and thermal conductivity.

In one embodiment, this Alloy comprises about 1.80 to about 2.00% by weight beryllium, 0.20 to 0.35% by weight cobalt, the balance being substantially copper.

Figure 1:
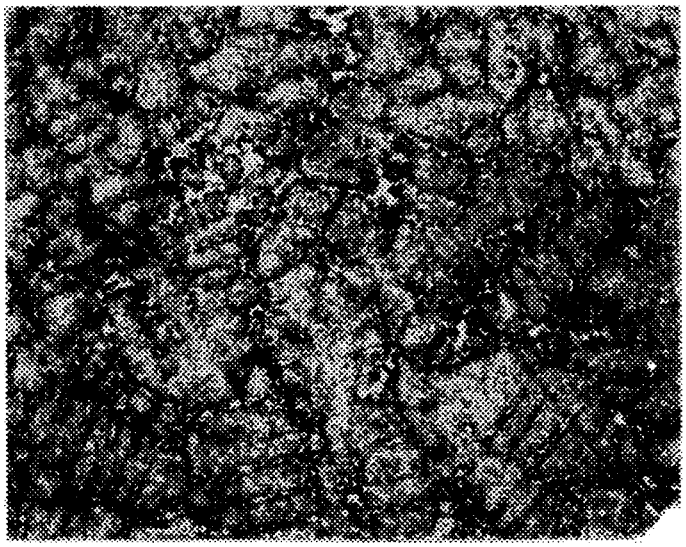
FIG. 1 is a micrograph of a cast input "gold" beryllium-copper alloy at 100× magnification, prior to homogenization, in accordance with one aspect of the present invention.

Upon commencement of metamorphic processing, a cast ingot or billet of Alloy 25 is homogenized and cropped, the alloy microstructure being shown in FIG. 1. The steps of homogenization and cropping are considered familiar to those skilled in the art and further explanation is believed unnecessary for purposes of the present invention.

Next, the alloy is thermodynamically treated for greater than, e.g., about 10 hours, at a first selected temperature generally within a range of 900° to 1500° F. Preferably, this treatment occurs for a selected time greater than about 16 hours. During treatment, the alloy is heated to the first temperature and held there for the selected duration.

Thermodynamic treatment preferably lasts greater than 16 hours at a first selected temperature generally within a range of 1000° and 1250° F. It is also preferred that annealing occur for about 30 minutes to about 1 hour and be accomplished by solution treatment. Thermal hardening for about 3 to 6 hours is particularly desirable. By the foregoing steps, grain size is refined with improvements in ultimate strength, total elongation, % reduction in area and toughness.

Figure 17:
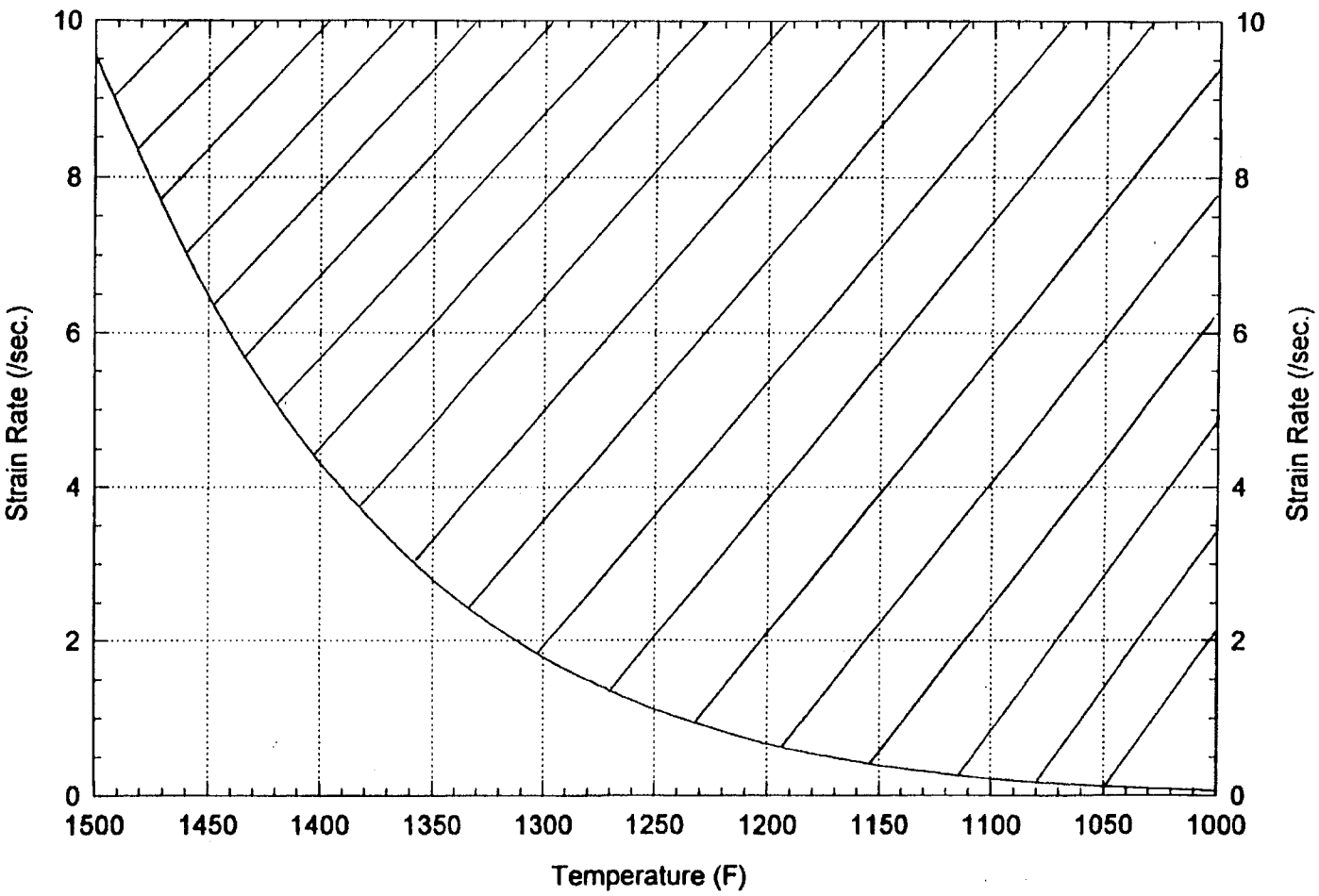
FIG. 17 is an illustrative metamorphic map of Alloy 25 showing the relationship between strain rate ($s^{-1}$) and hot working temperature (°F.)

After thermodynamic treatment, the alloy is warm worked. Warm working is preferably done by warm rolling the alloy, forging as with plates or bars, or by extrusion as with round products. During warm working, the alloy is maintained at the first selected temperature during which it is worked at greater than 30% strain at a strain rate $\dot{\varepsilon}$ greater than or equal to about $(2.210\times10^7)/\exp[(2.873\times10^4)/(T+495.4°)]$, where T is in °F. The preferred range of warm working is at greater than 50% strain generally between 0.5 and 10.0/second (or in/in/sec). A relationship between strain rate ($s^{-1}$) and hot working temperature (°F.) during warm working is illustrated by the metamorphic map of FIG. 17.

An objective of thermodynamic treatment and warm working is dynamic recovery of the alloy, i.e., to set up the alloy for static recrystallization which occurs later during the annealing step.

Figure 2:
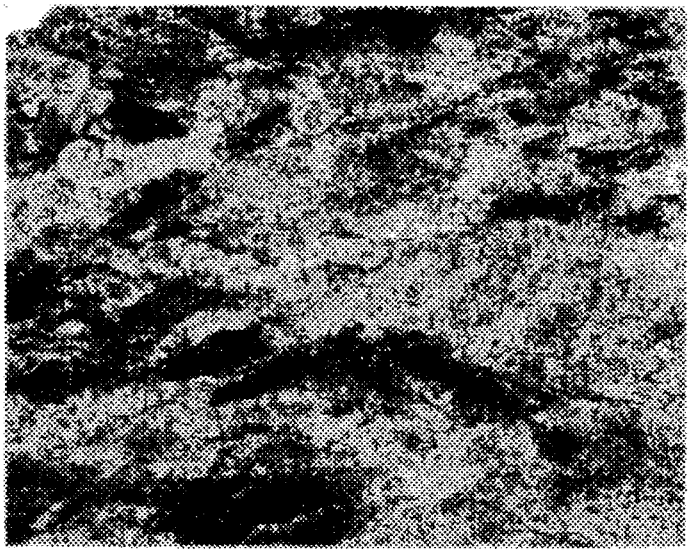
FIG. 2 is a micrograph of the alloy of FIG. 1 at 100× magnification, after the steps of thermodynamic treatment and warm working, in accordance with the present invention.
Figure 3:
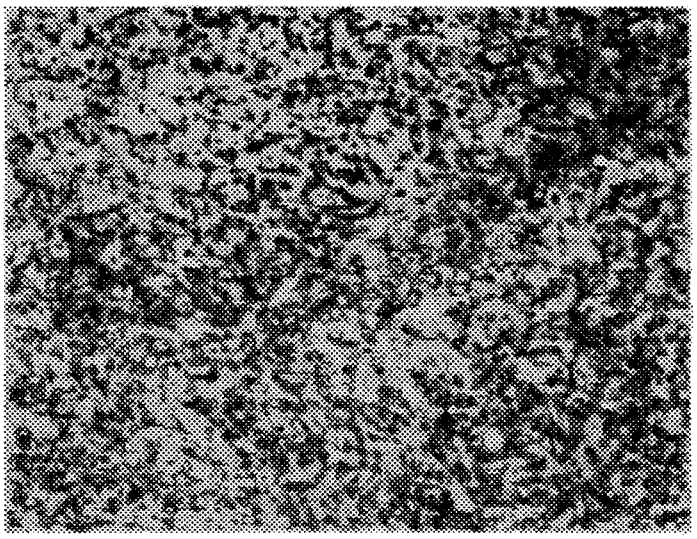
FIG. 3 is a micrograph of the alloy of FIG. 2 at 1000× magnification.

After the thermodynamic treatment and warm working steps (known as the metamorphic stage), a heterogeneous, quasi-amorphous, unrecrystallized (i.e., chaotic) grain structure is produced. As set forth in the micrographs of FIGS. 2 and 3 show, the grain structures produced are unlike those made by prior methods of enhancing material properties.

After warm working, the alloy is cooled at a rate, e.g., between 1000° F./second and 1° F./hour. Generally, it has been found that the rate of cooling the alloy at this phase of the process is a relatively less significant factor.

After cooling the alloy to a selected temperature, for example, room temperature, it is annealed at a second selected temperature generally within a range of 1375° and 1500° F. for about 15 minutes to about 3 hours. The preferred range is between 1375° and 1475° F. for about 30 minutes to about 1 hour.

Finally, the ingot is cooled by water quenching or a similar process, and thermal aged (or precipitation hardened) at a third selected temperature generally within a range of 480° and 660° F. for about 3 to 6 hours. Preferred times and temperatures may vary depending upon customer requirements.

Quenching and thermal aging, it has been found, not only resurrect but also enhance alloy grain structure and properties.

Figure 4:
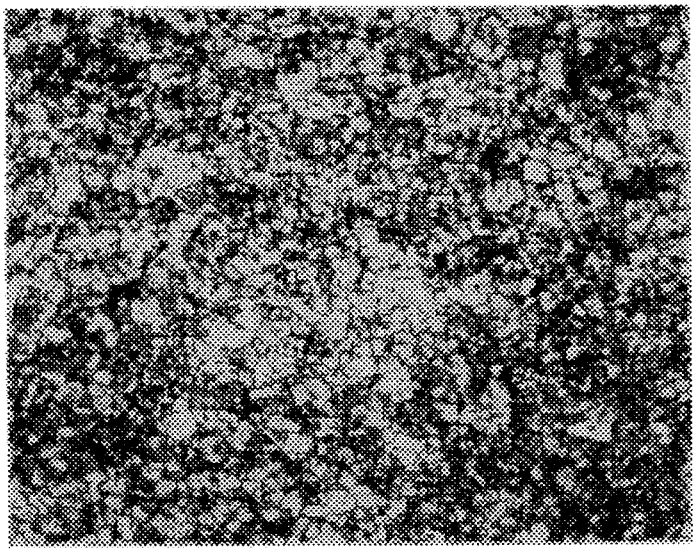
FIG. 4 is a micrograph of the alloy of FIG. 2 at 100× magnification, after the steps of annealing, quenching and thermal hardening in accordance with the present invention.

The result of metamorphic processing is a super Alloy 25 product having a refined equiaxed uniform grain structure. Its strength is superior to that obtained by prior processing methods, and ductility, formability, conductivity, ultrasonic inspectability are improved as well as resistance to heat and corrosion. A micrograph of the alloy product is shown, for example, in FIG. 4.

EXAMPLE I

A cast Alloy 25 input, metamorphically processed by the foregoing steps, resulted in a grain size of about 10–30 μm (microns). The alloy mechanical properties are as follows:

| Yield (ksi) | Ultimate (ksi) | Total Elongation | Reduction In Area (%) | CVN (ft. lbs.) |
|---|---|---|---|---|
| 100 | 140 | 19 | 40 | 35 |
| 160 | 180 | 8 | 14 | 5 |

Figure 5:
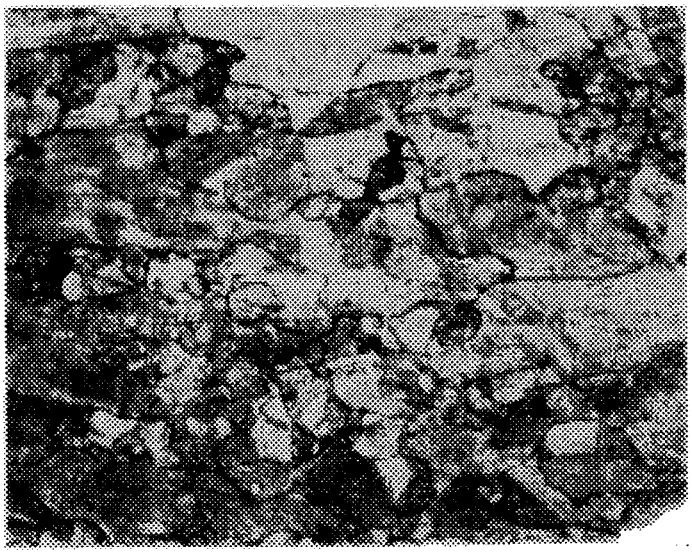
FIG. 5 is a micrograph of a wrought input "gold" beryllium-copper alloy at 100× magnification, in accordance with another aspect of the present invention.

In an alternative embodiment of the present invention, the input is a wrought "gold" beryllium-copper alloy ingot, as shown in FIG. 5. The steps of homogenizing and cropping may be omitted at this stage, as those skilled in the art will appreciate.

Figure 6:
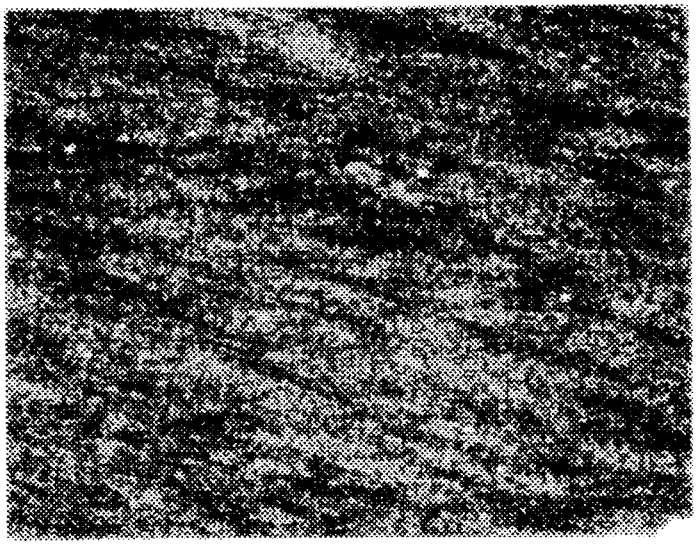
FIG. 6 is a micrograph of the alloy of FIG. 5 at 100× magnification, after the steps of thermodynamic treatment and warm working in accordance with the present invention.
Figure 7:
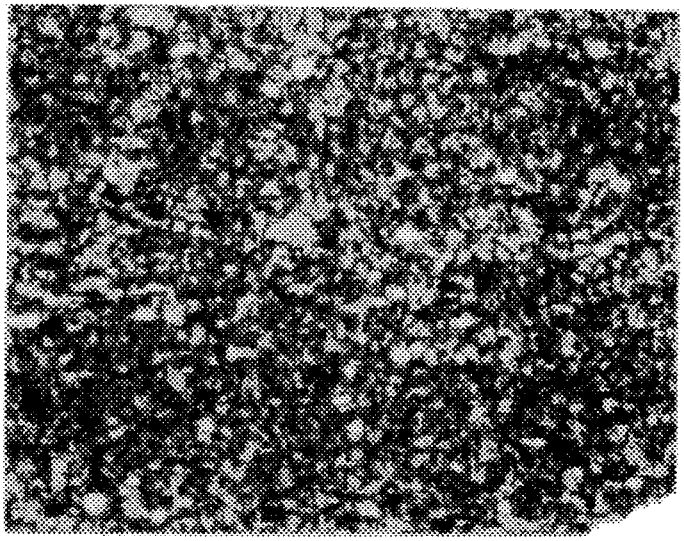
FIG. 7 is a micrograph of the alloy of FIG. 6 at 1000× magnification.
Figure 8:
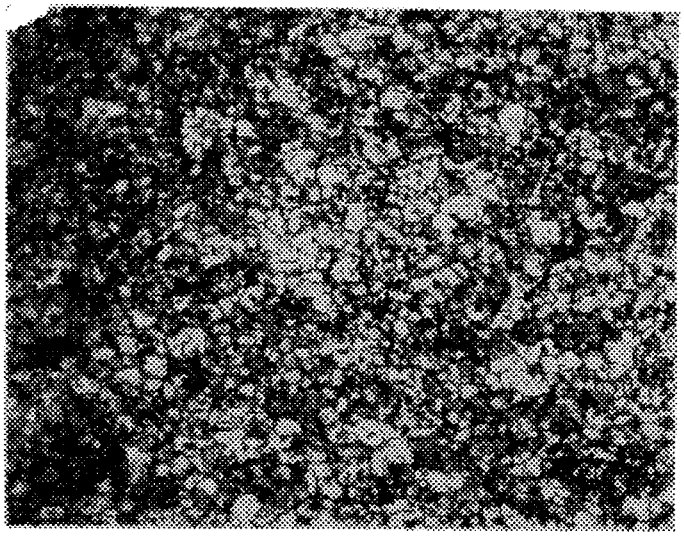
FIG. 8 is a micrograph of the alloy of FIG. 6 at 100× magnification, after the steps of annealing, quenching and thermal hardening in accordance with the present invention.

After the steps of thermodynamic treatment and warm working, the wrought alloy yields a chaotic grain microstructure as shown in FIGS. 6 and 7. Subsequent annealing, water quenching and thermal age hardening steps, in accordance with the present invention, produce a refined uniform, equiaxed grain structure as illustrated in FIG. 8.

EXAMPLE II

An ingot of Alloy 25, processed metamorphically by the foregoing steps, also resulted in a grain size of about 10–30 μm, and the following mechanical properties:

| Yield (ksi) | Ultimate (ksi) | Total Elongation | Reduction In Area (%) | CVN (ft. lbs.) |
|---|---|---|---|---|
| 100 | 140 | 19 | 40 | 35 |
| 160 | 180 | 8 | 14 | 5 |

As this demonstrates, the properties of a selected metamorphically processed alloy have been found the same whether input in cast or wrought form. As such, this technique advantageously permits cost-effective mass production of high performance beryllium-copper alloys in cast or wrought form. An overall objective of the present invention is to improve properties of bulk alloy products such as plates and sections of beryllium-copper and other alloys.

Specific, illustrative metamorphic processing of another "gold" beryllium-copper alloy, e.g., Alloy 165 (C17000), comprises the steps of: (i) thermodynamically treating the alloy at a first selected temperature generally within a range of 900° and 1500° F., (ii) warm working the alloy of step i at greater than about 30% strain at a strain rate $\dot{\varepsilon}$ greater than or equal to about $(1.009\times10^8)/\exp[(2.873\times10^4)/(T+459.4°)]$, where T is in °F., at the first temperature, (iii) annealing the alloy of step ii at a second selected temperature generally within a range of 1375° and 1500° F., (iv) water quenching the alloy of step iii, and (v) thermal hardening the alloy of step iv at a third selected temperature generally within a range of about 480° and 660° F.

Alloy 165 has been found useful in the construction of optical amplifier housings for undersea fiber optic components, particularly for its corrosion resistance, thermal conductivity toughness and strength.

In one embodiment of the present invention, Alloy 165 is comprised of about 1.60 to about 1.79% beryllium, 0.20 to 0.35% cobalt, the balance being substantially copper.

Figure 18:
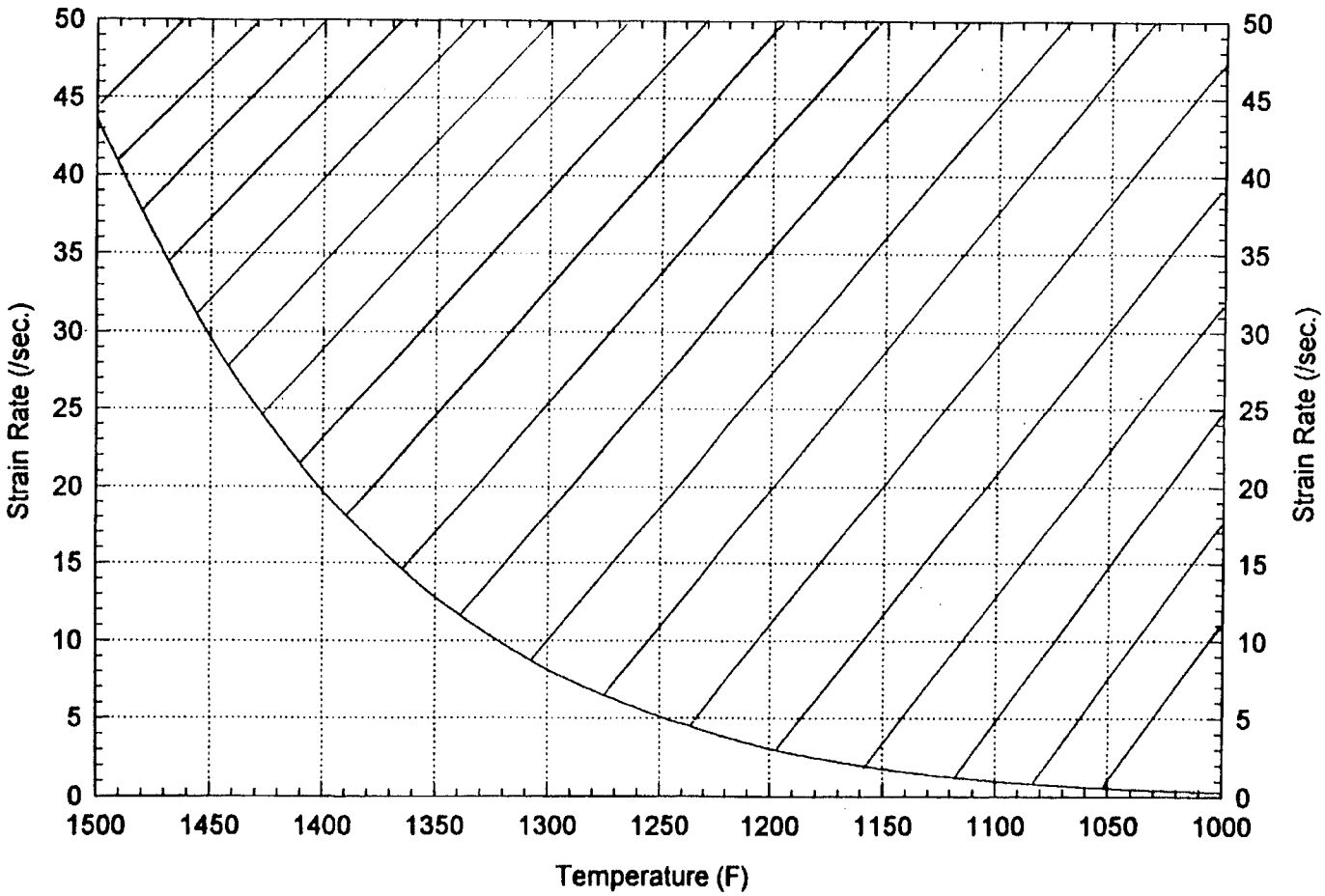
FIG. 18 is an illustrative metamorphic map of Alloy 165 showing the relationship between strain rate ($s^{-1}$) and hot working temperature (°F.)

To refine grain size with concomitant improvements in ultimate strength, total elongation, % reduction in area and toughness, the alloy is preferably treated thermodynamically for greater than about 10 hours, e.g., about 16 hours, at a first selected temperature generally within a range of 1000° and 1250° F. Also, it is desirable to anneal by solution treatment for about 30 minutes to about 1 hour, and thermal harden the alloy for about 3 to 6 hours. The designated region in FIG. 18 illustrates a relationship between strain rate ($s^{-1}$) and hot working temperature (° F.) during warm working.

Finally, it has been found that metamorphically processed "gold" beryllium-copper alloys have a unique property fingerprint. For instance, 3.0 times the impact energy of a metamorphically processed "gold" alloy in foot pounds plus 2.0 times its yield strength in ksi is greater than about 275.

Turning now to a further aspect of the present invention, metamorphic processing is performed on a "red" beryllium-copper alloy. According to one embodiment, Alloy 3 (C17510) is metamorphically processed by (i) thermodynamically treating the alloy at a first selected temperature generally within a range of 900° and 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, (iii) annealing the alloy of step ii at a second selected temperature generally within a range of 1400° and 1750° F. for about 15 minutes to about 3 hours, (iv) water quenching the alloy of step iii, and (v) thermal hardening the alloy of step iv at a third selected temperature generally within a range of 800° and 1000° F. By this method, a generally equiaxed uniform grain structure is again produced with concomitant improvements in mechanical properties, electrical conductivity and ultrasonic inspectability.

Properties of Alloy 3 such as its hardness-strength, thermal conductivity, toughness, and corrosion resistance make this alloy suitable for use in weld tooling and containers for nuclear and chemical waste.

By the present method, the alloy is preferably treated thermodynamically for greater than about 10 hours and annealed by solution treatment for about 15 minutes to about 3 hours. This is done to achieve optimum refinement in grain size and improve electrical conductivity, ultimate strength, toughness, total elongation and % reduction in area. Later, after water quenching, the alloy is hardened thermally for about 2 to 3 hours.

Metamorphic processing of other "red" alloys, e.g., HYCON 3 HP™ and PHASE 3 HP™, likewise produces a generally equiaxed uniform grain structure with improved mechanical properties, electrical conductivity and ultrasonic inspectability. One such process comprises the steps of: (i) thermodynamically treating the alloy at a first selected temperature generally within a range of 900° and 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, (iii) annealing the alloy of step ii at a second selected temperature generally within a range of 1400° and 1750° F., (iv) water quenching the alloy of step iii, and (v) primary thermal hardening of the alloy of step iv at a third selected temperature generally within a range of 900° and 1000° F. followed by secondary thermal hardening at a fourth selected temperature generally within a range of 700° and 900° F.

HYCON 3 HP™ is desirable for use in nuclear fusion and cryogenic systems, particularly those high energy field magnets used for imaging. This is due to properties such as thermal and electrical conductivity, strength, toughness, corrosion resistance and ultrasonic inspectability.

PHASE 3 HP™ is a material of choice for face plates of continuous steel casting molds. This alloy has been noted for superior thermal conductivity (and management), thermal cycling, strength, toughness, corrosion resistance and ultrasonic inspectability.

In accordance with various aspects of the present invention, Alloy 3, HYCON 3 HP™, and PHASE 3 HP™ are comprised of about 0.20 to about 0.60% beryllium, about 1.4 to about 2.2% nickel, the balance being substantially copper.

Figure 9:
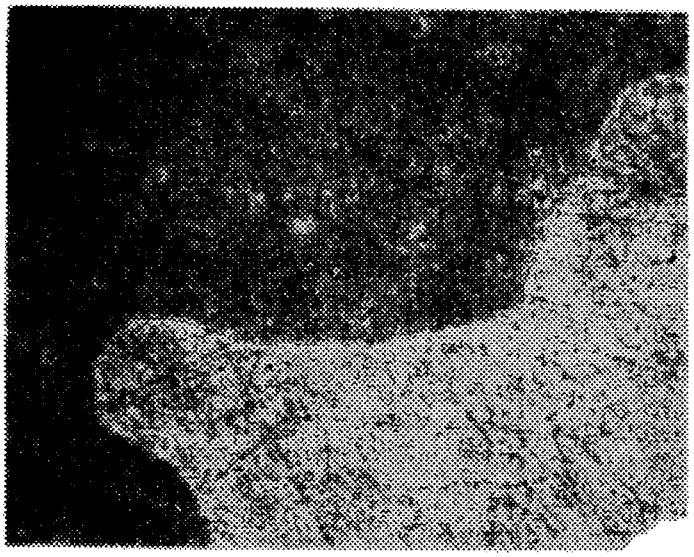
FIG. 9 is a micrograph of a cast input "red" beryllium-copper alloy at 100× magnification, prior to homogenization, in accordance with a further aspect of the present invention.
Figure 13:
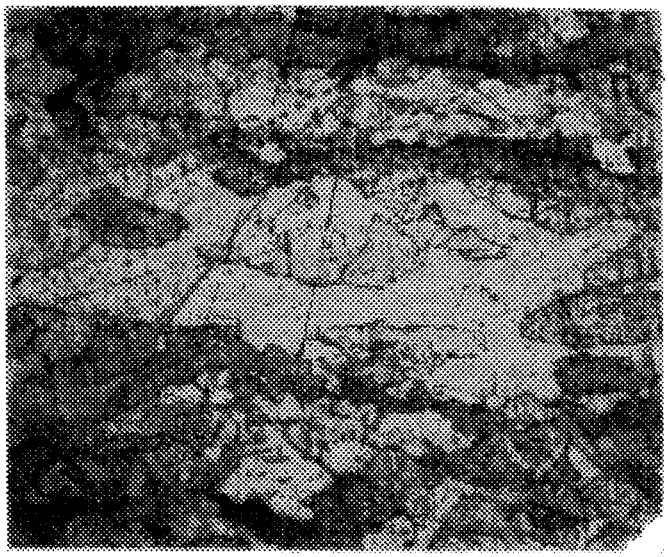
FIG. 13 is a micrograph of a wrought input "red" beryllium-copper alloy at 100× magnification, in accordance with yet another aspect of the present invention.

Initially, according to one embodiment, a cast Alloy 3 (or HYCON) ingot is homogenized and cropped, as above. The initial microstructure is shown in FIG. 9. Alternatively, wrought input is used, as best seen in FIG. 13.

Next, the alloy is thermodynamically treated for greater than, e.g., about 10 hours, at a first selected temperature generally within a range of 900° to 1850° F. During this step, the alloy is heated to the first temperature and held there for the selected duration.

Figure 19:
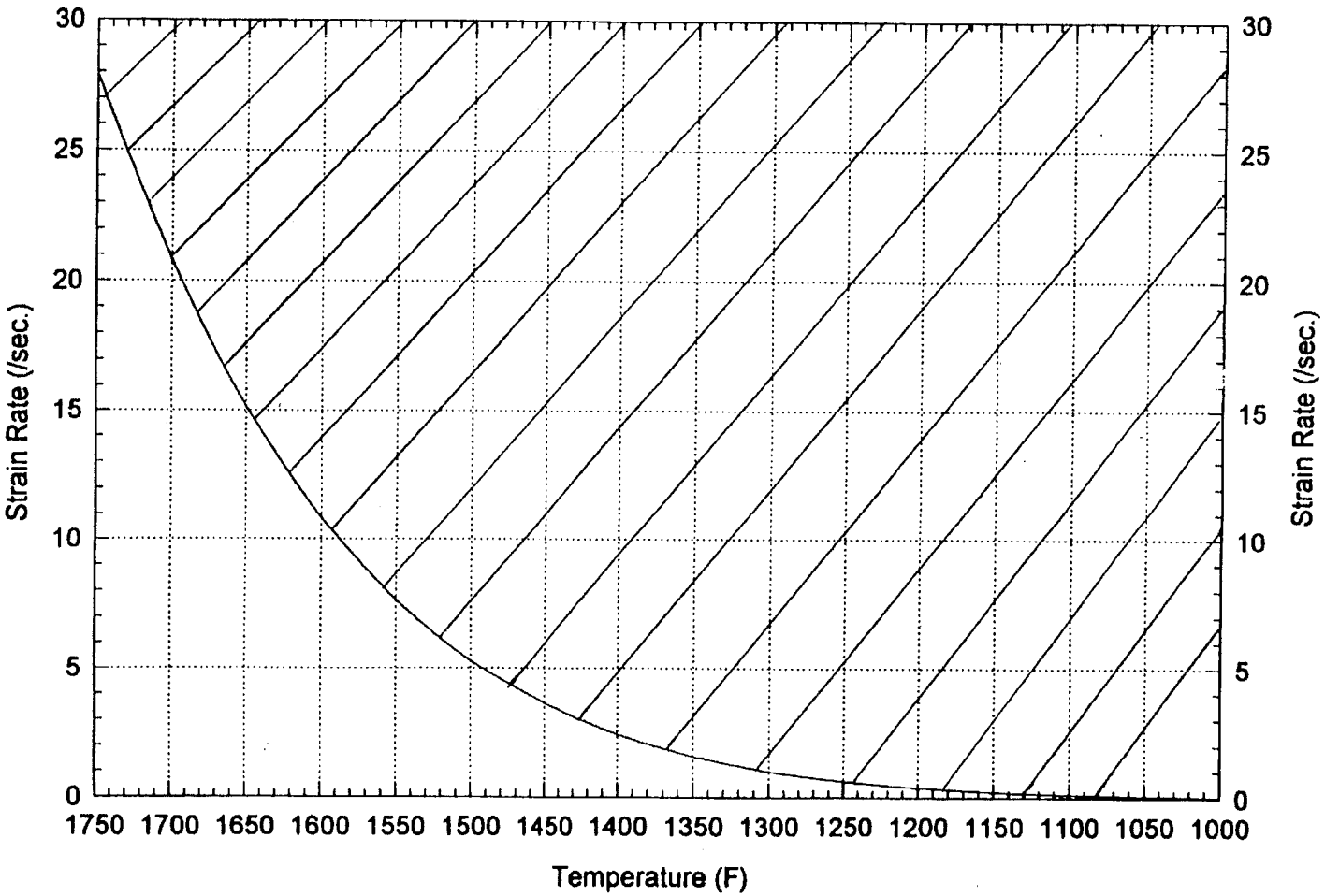
FIG. 19 is an illustrative metamorphic map of Alloy 3, HYCON 3HP™ and PHASE 3HP™ showing the relationship between strain rate ($s^{-1}$) and hot working temperature (°F.).

During warm working, the alloy is maintained at the first selected temperature during which it is worked at greater than 30% strain at a strain of $\dot{\epsilon}$ greater than or equal to about $(1.243\times10^7)/\exp[(2.873\times10^4)/(T+495.4°)]$, where T is in °F. The preferred range of warm working is at greater than 50% strain generally between 0.5 and 10.0/second (or in/in/sec). A relationship between strain rate ($s^{-1}$) and hot working temperature (° F.) for Alloy 3, HYCON 3HP™ and PHASE 3HP™ is set forth in the metamorphic map of FIG. 19.

Figure 10:
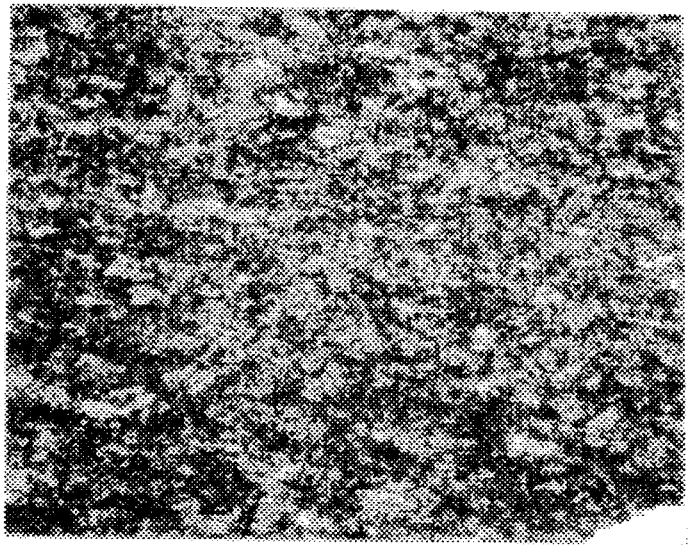
FIG. 10 is a micrograph of the alloy of FIG. 9 at 100× magnification, after the steps of thermodynamic treatment and warm working, in accordance with the present invention.
Figure 11:
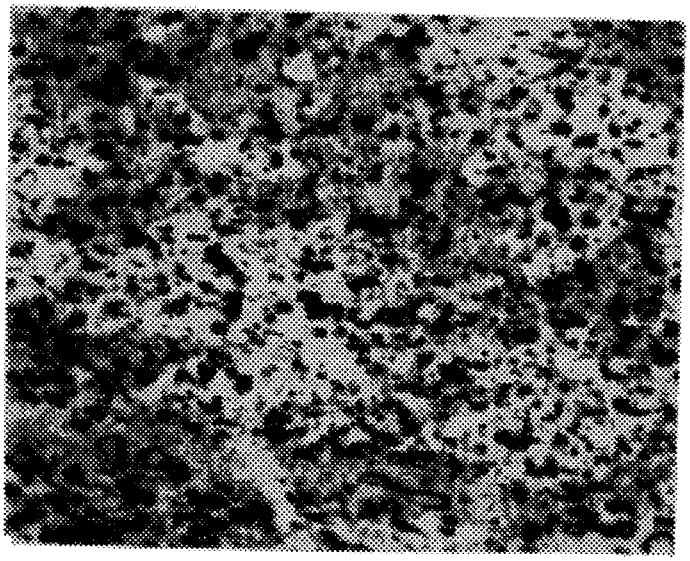
FIG. 11 is a micrograph of the alloy of FIG. 10 at 1000× magnification.
Figure 14:
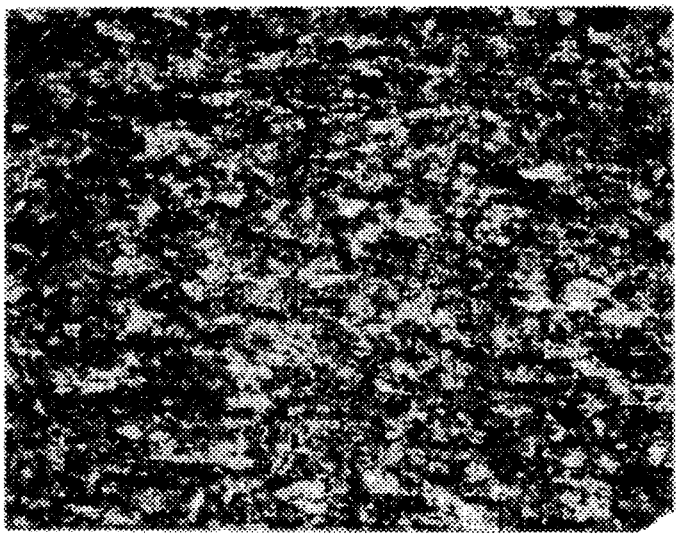
FIG. 14 is a micrograph of the alloy of FIG. 13 at 100× magnification, after the steps of thermodynamic treatment and warm working in accordance with the present invention.
Figure 15:
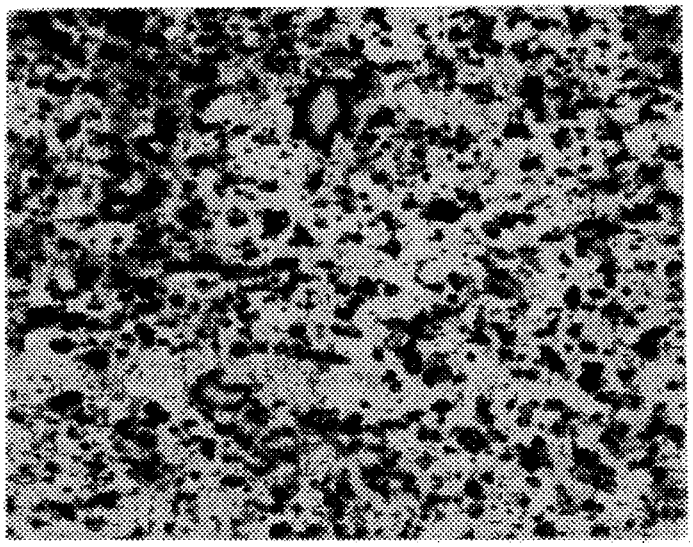
FIG. 15 is a micrograph of the alloy of FIG. 14 at 1000× magnification.

Micrographs of the alloy after the steps of thermodynamic treatment and warm working are shown, for example, in FIGS. 10 and 11 (from cast input) and FIGS. 14 and 15 (from wrought input). During this "metamorphic" stage, unlike prior methods of enhancing material properties, a heterogeneous, quasi-amorphous, unrecrystallized (i.e., chaotic) grain structure is produced.

Again, warm working may be done by warm rolling or forging as with plates or bars of the alloy, or by extrusion as with round products.

After warm working, the alloy is cooled to a selected temperature, for example, room temperature, at a rate preferably between 1000° F./second and 1° F./hour. The material is then annealed at a second selected temperature generally within a range of 1375° and 1750° F. for about 15 minutes to about 3 hours. The preferred range is between 1400° and 1750° F. The alloy is cooled by water quenching or a similar process.

Figure 12:
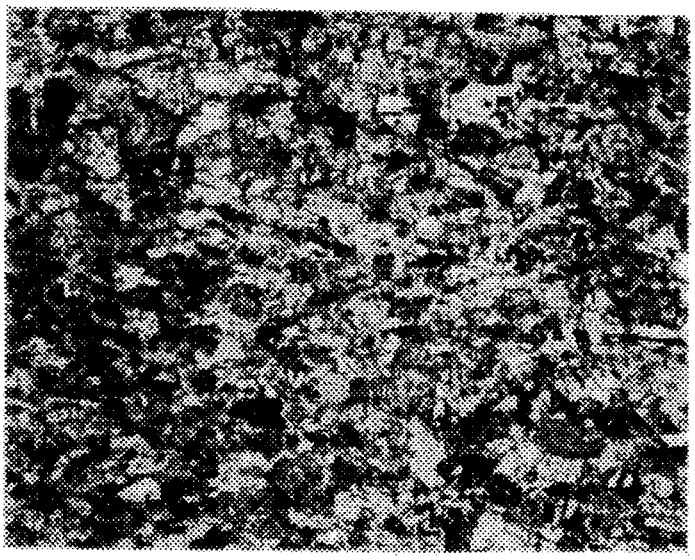
FIG. 12 is a micrograph of the alloy of FIG. 10 at 100× magnification, after the steps of annealing, quenching and thermal hardening in accordance with the present invention.
Figure 16:
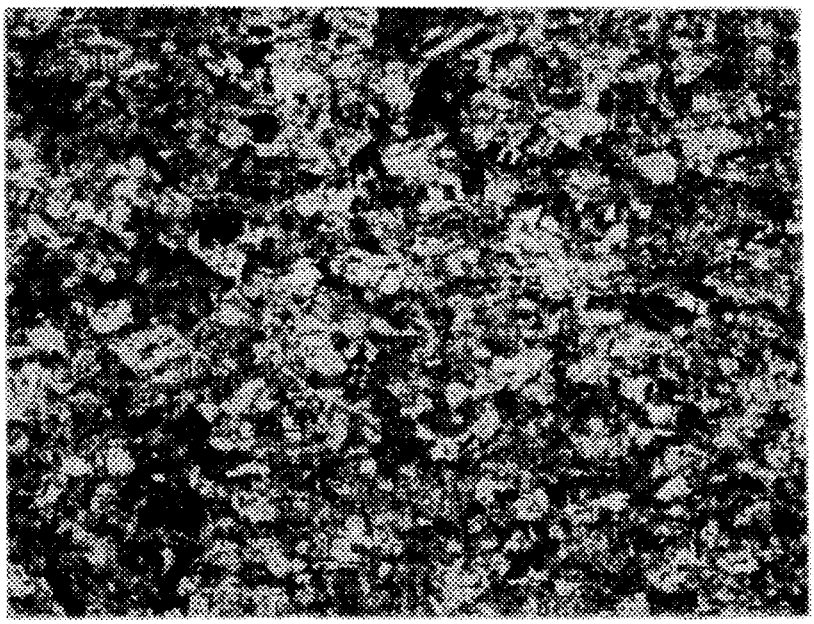
FIG. 16 is a micrograph of the alloy of FIG. 14 at 100× magnification, after the steps of annealing, quenching and thermal hardening in accordance with the present invention.

Finally, an initial or primary thermal hardening step is conducted at a third selected temperature generally within a range of 900° and 1000° F. The preferred duration of this step is between about 2 to 10 hours. This is followed by secondary thermal hardening at a fourth selected temperature generally within a range of 700° and 900° F. for about 10 to 30 hours. Preferred third temperatures are generally within a range of 925° and 1000° F., and fourth temperatures are generally within a range of 750° and 850° F. Specific, illustrative microstructures which result are shown in FIG. 12 (from cast input) and FIG. 16 (from wrought input).

To refine grain size with concomitant improvements in electrical conductivity, ultimate strength, toughness, total elongation and % reduction in area, it is desirable to thermodynamically treat the alloy for greater than about 10 hours, and anneal by solution treatment for about 15 minutes to about 3 hours. It is also preferred that primary thermal hardening take place at a third selected temperature generally within a range of 925° and 1000° F. for about 2 to 10 hours followed by secondary thermal hardening at a fourth selected temperature generally within a range of 750° and 850° F. for about 10 to 30 hours.

Metamorphic processing of "red" alloys, it has been found, results in a superior average grain size of, e.g., about 20–50 μm, which is desirable.

In general, refinement in the size of grains having equiaxed uniform structure has many advantages. It permits finer polishability of mirrors for missile guidance systems and of plastic injection molds used in the production of compact disks. Improved thermal conductivity and ultrasonic inspectability are also useful for heat exchangers of computers.

Metamorphically processed "red" beryllium-copper alloys, like the "gold" alloys, are further unique in the relationship of their respective properties. For example, 4.5 times the electrical conductivity of such alloy in % IACS plus the alloy yield strength in ksi is greater than about 400.

Although the embodiments illustrated herein have been described for use with beryllium-copper alloys, it is understood that analogous processes may be practiced on other precipitation hardenable materials such as alloys of aluminum, titanium, and iron, giving consideration to the purpose for which the present invention is intended. Also, any alloy containing beryllium, including beryllium-nickel and beryllium-silver alloys, are considered within the spirit and scope of the present invention. While the present invention is intended to apply to the whole spectrum of beryllium-copper alloys in bulk sections, but other suitable applications will be appreciated.

Various modifications and alterations to the present invention may be appreciated based on a review of this disclosure. These changes and additions are intended to be within the scope and spirit of this invention as defined by the following claims.

What is claimed is:

1. Metamorphic processing of a beryllium-copper alloy which consists essentially of about 1.80 to about 2.00% by weight beryllium, about 0.20 to about 0.35% by weight cobalt, the balance being copper, so as to produce an equiaxed uniform fine grain structure with concomitant improvements in mechanical properties and ultrasonic inspectability, which comprises the steps of:

(i) thermodynamically treating the alloy at a first selected temperature within a range of about 900° and about 1500° F., (ii) warm working the alloy of step i at greater than about 30% strain at a strain rate $\dot{\epsilon}$ greater than or equal to about $(2.210\times10^7)/\exp[(2.873\times10^4)/(T+459.4°)]$, where T is in ° F., at the first temperature, so as to produce a heterogeneous, quasiamorphous, unrecrystallized grain structure, (iii) annealing the alloy of step ii at a second selected temperature within a range of about 1375° and about 1500° F., (iv) water quenching the alloy of step iii, and (v) thermal hardening the alloy of step iv at a third selected temperature within a range of about 480° and about 660° F. so as to provide a refined equiaxed uniform grain structure, where 3.0 times the impact energy of the alloy in foot pounds plus 2.0 times the alloy yield strength in ksi is greater than about 275.

2. The process set forth in claim 1 wherein the alloy input is a cast ingot homogenized prior to step i.

3. The process set forth in claim 1 wherein the alloy of step ii is cooled between steps ii and iii at a rate generally within a range of 1000° F./second and 1° F./hour.

4. The process set forth in claim 1 wherein the alloy input is in wrought form.

5. The process set forth in claim 1 wherein the alloy of step i is warm worked by warm rolling.

6. The process set forth in claim 1 wherein the alloy of step i is warm worked by warm forging.

7. The process set forth in claim 1 wherein the alloy of step i is warm worked by warm extrusion.

8. Metamorphic processing of a beryllium-copper alloy which consists essentially of about 1.80 to about 2.00% by weight beryllium, about 0.20 to about 0.35% by weight cobalt, the balance being copper, so as to refine grain size with concomitant improvements in ultimate strength, total elongation, % reduction in area and toughness, which comprises the steps of:

(i) thermodynamically treating the alloy for greater than about 16 hours at a first selected temperature within a range of about 1000° and about 1250° F., (ii) warm working the alloy of step i at greater than about 30% strain at a strain rate $\dot{\epsilon}$ greater than or equal to about $(2.210\times10^7)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1375° and about 1475° F. for about 30 minutes to about 1 hour, (iv) water quenching the alloy of step iii, and (v) thermal hardening the alloy of step iv at a third selected temperature within a range of about 480° and about 660° F. for about 3 to 6 hours so as to provide a refined equiaxed uniform grain structure, where 3.0 times the impact energy of the alloy in foot pounds plus 2.0 times the alloy yield strength in ksi is greater than about 275.

9. The process set forth in claim 8 wherein the alloy input is a cast ingot homogenized prior to step i.

10. The process set forth in claim 8 wherein the alloy of step ii is cooled between steps ii and iii at a rate generally within a range of 1000° F./second and 1° F./hour.

11. The process set forth in claim 8 wherein the alloy input is in wrought form.

12. The process set forth in claim 8 wherein the alloy of step i is warm worked by warm rolling.

13. The process set forth in claim 8 wherein the alloy of step i is warm worked by forging.

14. The process set forth in claim 8 wherein the alloy of step i is warm worked by extrusion.

15. Metamorphic processing of a beryllium-copper alloy which consists essentially of about 1.60 to about 1.79% by weight beryllium, about 0.20 to about 0.35% by weight cobalt, the balance being copper, so as to produce an equiaxed uniform grain structure with concomitant improvements in mechanical properties and ultrasonic inspectability, which comprises the steps of:

(i) thermodynamically treating the alloy at a first selected temperature within a range of about 900° and about 1500° F., (ii) warm working the alloy of step i at greater than about 30% strain at a strain rate $\dot{\epsilon}$ greater than or equal to about $(1.009\times10^8)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1375° and about 1500° F., (iv) water quenching the alloy of step iii, and (v) thermal hardening the alloy of step iv at a third selected temperature within a range of about 480° and about 660° F. so as to provide a refined equiaxed uniform grain structure, where 3.0 times the impact energy of the alloy in foot pounds plus 2.0 times the alloy yield strength in ksi is greater than about 275.

16. The process set forth in claim 15 wherein the alloy input is a cast ingot homogenized prior to step i.

17. The process set for in claim 15 wherein the alloy of step ii is cooled between steps ii and iii at a rate generally within a range of 1000° F./second and 1° F./hour.

18. The process set forth in claim 15 wherein the alloy input is in wrought form.

19. The process set forth in claim 15 wherein the alloy of step i is warm worked by warm rolling.

20. The process set forth in claim 15 wherein the alloy of step i is warm worked by warm forging.

21. The process set forth in claim 15 wherein the alloy of step i is warm worked by warm extrusion.

22. Metamorphic processing of a beryllium-copper alloy which consists essentially of about 1.60 to about 1.79% by weight beryllium, about 0.20 to about 0.35% by weight cobalt, the balance being copper, so as to refine grain size with concomitant improvements in ultimate strength, total elongation, % reduction in area and toughness, which comprises the steps of:

(i) thermodynamically treating the alloy for greater than about 16 hours at a first selected temperature within a range of about 1000° and about 1250° F., (ii) warm working the alloy of step i at greater than about 30% strain at a strain rate $\dot{\epsilon}$ greater than or equal to about $(1.009\times10^8)/\exp[(2.873\times10^4)/(T+459.4°)]$, where T is in ° F., at the first temperature, so as to produce a heterogeneous, quasiamorphous, unrecrystallized grain structure, (iii) annealing the alloy of step ii at a second selected temperature within a range of about 1375° and about 1475° F. for about 30 minutes to about 1 hour, (iv) water quenching the alloy of step iii, and (v) thermal hardening the alloy of step iv at a third selected temperature within a range of about 480° and about 660° F. for about 3 to 6 hours so as to provide a refined equiaxed uniform grain structure, where 3.0 times the impact energy of the alloy in foot pounds plus 2.0 times the alloy yield strength in ksi is greater than about 275.

23. The process set forth in claim 22 wherein the alloy input is a cast ingot homogenized prior to step i.

24. The process set forth in claim 22 wherein the alloy of step ii is cooled between steps ii and iii at a rate generally within a range of 1000° F./second and 1° F./hour.

25. The process set forth in claim 22 wherein the alloy input is in wrought form.

26. The process set forth in claim 22 wherein the alloy of step i is warm worked by warm rolling.

27. The process set forth in claim 22 wherein the alloy of step i is warm worked by warm forging.

28. The process set forth in claim 22 wherein the alloy of step i is warm worked by warm extrusion.

29. Metamorphic processing of a beryllium-copper alloy which consists essentially of about 0.20 to about 0.60% by weight beryllium, about 1.40 to about 2.20% by weight nickel, the balance being copper, so as to produce an equiaxed uniform grain structure with concomitant improvements in mechanical properties, electrical conductivity and ultrasonic inspectability, which comprises the steps of:

(i) thermodynamically treating the alloy at a first selected temperature within a range of about 900° and about 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1400° and about 1750° F. for about 15 minutes to about 3 hours, (iv) water quenching the alloy of step iii, and (v) thermal hardening the alloy of step iv at a third selected temperature within a range of about 800° and about 1000° F. so as to provide a refined equiaxed uniform grain structure, where 4.5 times the electrical conductivity of the alloy in % IACS plus the alloy yield strength in ksi is greater than about 400.

30. Metamorphic processing of a beryllium-copper alloy which consists essentially of about 0.20 to about 0.60% by weight beryllium, about 1.40 to about 2.20% by weight nickel, the balance being copper, so as to refine grain size with concomitant improvements in electrical conductivity, ultimate strength, total elongation, % reduction in area and toughness, which comprises the steps of:

(i) thermodynamically treating the alloy for greater than about 10 hours at a first selected temperature within a range of about 900° and about 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1400° and about 1750° F. for about 15 minutes to about 3 hours, (iv) water quenching the alloy of step iii, and (v) thermal hardening the alloy of step iv at a third selected temperature within a range of about 900° and about 950° F. for about 2 to 3 hours so as to provide a refined equiaxed uniform grain structure, where 4.5 times the electrical conductivity of the alloy in % IACS plus the alloy yield strength in ksi is greater than about 400.

31. Metamorphic processing of a beryllium-copper alloy which consists essentially of about 0.20 to about 0.60% by weight beryllium, about 1.40 to about 2.20% by weight nickel, the balance being copper, so as to produce an equiaxed uniform grain structure with concomitant improvements in mechanical properties, electrical conductivity and ultrasonic inspectability, which comprises the steps of:

(i) thermodynamically treating the alloy at a first selected temperature within a range of about 900° and about 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1400° and about 1750° F., (iv) water quenching the alloy of step iii, and (v) primary thermal hardening of the alloy of step iv at a third selected temperature within a range of about 900° and about 1000° F. followed by secondary thermal hardening at a fourth selected temperature within a range of about 700° and about 900° F. so as to provide a refined equiaxed uniform grain structure, where 4.5 times the electrical conductivity of the alloy in % IACS plus the alloy yield strength in ksi is greater than about 400.

32. Metamorphic processing of a beryllium-copper alloy which consisting essentially of about 0.20 to about 0.60% by weight beryllium, about 1.40 to about 2.20% by weight nickel, the balance being copper, so as to refine grain size with concomitant improvements in electrical conductivity, ultimate strength, total elongation, % reduction in area and toughness, which comprises the steps of:

(i) thermodynamically treating the alloy for greater than about 10 hours at a first selected temperature within a range of about 900° and about 1850° F., (ii) warm working the alloy of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, so as to produce a heterogeneous, quasiamorphous, unrecrystallized grain structure, (iii) annealing the alloy of step ii at a second selected temperature within a range of about 1400° and about 1750° F. for about 15 minutes to about 3 hours, (iv) water quenching the alloy of step iii, and (v) primary thermal hardening the alloy of step iv at a third selected temperature within a range of about 925° and about 1000° F. for about 2 to 10 hours followed by secondary thermal hardening at a fourth selected temperature within a range of about 750° and about 850° F. for about 10 to 30 hours so as to provide a refined equiaxed uniform grain structure, where 4.5 the times electrical conductivity of the alloy in % IACS plus the alloy yield strength in ksi is greater than about 400.

33. Metamorphic processing of a material which consists essentially of about 0.20 to about 0.60% by weight beryllium, about 1.40 to about 2.20% by weight nickel, the balance being copper, so as to produce an equiaxed uniform fine grain structure with concomitant improvements in material properties and characteristics, which comprises the steps of:

(i) thermodynamically treating the material at a first selected temperature within a range of about 900° and about 1700° F., (ii) warm working the material of step i at greater than about 30% strain at a strain rate $\dot{\epsilon}$ greater than or equal to about $(1.243\times10^7)/\exp[(2.873\times10^4)/(T+459.4°)]$, where T is in °F., at the first temperature, so as to produce a heterogeneous, quasiamorphous, unrecrystallized grain structure, (iii) annealing the material of step ii at a second selected temperature within a range of about 1375° and about 1750° F., (iv) water quenching the material of step iii, and (v) thermal hardening the material of step iv at a third selected temperature within a range of about 600° and about 1000° F. so as to provide a refined equiaxed uniform grain structure, where 4.5 times the electrical conductivity of the material in % IACS plus the material yield strength in ksi is greater than about 400.

* * * * *